United States Patent [19]

Johnson

[11] 4,413,579

[45] * Nov. 8, 1983

[54] BOBBIN CASE RETAINING MEANS

[75] Inventor: Ralph E. Johnson, Convent Station, N.J.

[73] Assignee: The Singer Company, Stamford, Conn.

[ * ] Notice: The portion of the term of this patent subsequent to Oct. 6, 1998 has been disclaimed.

[21] Appl. No.: 275,168

[22] Filed: Jun. 19, 1981

[51] Int. Cl.[3] ..... D05B 57/14; D05B 57/26

[52] U.S. Cl. ..... 112/184; 112/231

[58] Field of Search ..... 112/181, 184, 228, 229, 112/230, 231

[56] References Cited

U.S. PATENT DOCUMENTS

| | | | |
|---|---|---|---|
| 1,996,290 | 4/1935 | Gunther | 112/184 |
| 3,373,707 | 3/1968 | Ketterer | 112/184 |
| 3,416,472 | 12/1968 | Johnson | 112/184 |
| 4,121,527 | 10/1978 | Johnson | 112/184 X |
| 4,292,906 | 10/1981 | Johnson | 112/184 |

*Primary Examiner*—Wm. Carter Reynolds

*Attorney, Agent, or Firm*—Robert E. Smith; Edward L. Bell

[57] ABSTRACT

A bobbin case positioning and retaining structure of one piece unitary construction for maintaining the bobbin case in proper operating position. The bobbin case is held captive without the need for operator manipulatable locking devices.

5 Claims, 7 Drawing Figures

BOBBIN CASE RETAINING MEANS

DESCRIPTION

BACKGROUND OF THE INVENTION

This invention relates to means for positioning and retaining a bobbin case in operating engagement with the loop taker of a sewing machine.

Bobbin case retaining and positioning means having no operator actuatable parts are known in the art. See for example, U.S. Pat. No. 3,373,707, Mar. 19, 1968, Ketterer, the teachings of which are incorporated herein by reference. Such construction permits insertion or removal of the bobbin case by the operator without the need to manipulate a locking lever or other similar device. This very feature, however, permits the bobbin case to move out of position for correct operation under certain operating conditions. That is because the bobbin case can be inserted into and removed from operating position within the controlled embrace of the bobbin case retaining bracket, without manipulation of a locking means, the bobbin case may be urged out of operating position by vibrational and other forces that normally occur within an operating sewing machine. This frequently affects the appearance of the stitches or results in bobbin thread breakage. Other constructions, on the other hand, utilize a locking device which may be manipulated by the operator for retaining the bobbin case in operating position. Such locking devices usually take the form of a sliding or pivoting member that may be positioned so that removal of the bobbin case from its operating position is blocked. See, for example, U.S. Pat. No. 4,292,906, Oct. 6, 1981, the rights of which are owned by the assignee of the present invention and the teachings of which are incorporated herein by reference. Such constructions have the disadvantages inherent in assemblies of multiple parts such as difficulty in precisely positioning the parts due to tolerance build up and increased manufacturing and maintenance costs due to the more complex construction.

The present invention overcomes these disadvantages through the use of a novel but simple device.

SUMMARY OF THE INVENTION

It is an object of this invention to provide a bobbin case positioning and retaining means of one piece, unitary construction.

It is another object of this invention to provide a bobbin case positioning and retaining means that maintains the bobbin case in operating position for sewing notwithstanding the presence of vibrational and other normally occurring forces that tend to urge the bobbin case out of position.

It is another object of this invention to provide a bobbin case positioning and retaining means that requires no operator manipulated locking device for retaining the bobbin case in operating position.

Other objects and advantages of the invention will become apparent through reference to the accompanying drawings and descriptive matter which illustrates a preferred embodiment of the invention.

According to the present invention there is provided a sewing machine having a work supporting bed and a loop taker arranged for rotation about a vertical axis, wherein the loop taker has a rim including a beak formed therein for seizing thread carried by a reciprocating needle. A bobbin case is included within the loop taker and a bracket removably attached to the bed is loosely connected to the bobbin case to constrain the bobbin case rotationally angularly and vertically and permit the passage of needle thread between the bobbin case and the bracket during the formation of lockstitches. The bobbin case is vertically supported only at a first location on the bracket and at a second location on the rim of the loop taker. The bracket is of unitary integral construction having a vertical wall adjacent the first location on the bracket for loosely abutting the bobbin case. The bracket overlays a portion of the bobbin case in third and fourth spaced apart locations both of which are positioned on one side of a plane containing the vertical axis of the loop taker while the first location is positioned on the other side of the plane. The bobbin case is thereby restrained in operational engagement with the rim and removal of the bobbin case is prevented without removal of the bracket.

BRIEF DESCRIPTION OF THE DRAWINGS

In order that the invention be more fully understood, it will be described by way of example with reference to the accompanying drawings in which.

DESCRIPTION OF THE PREFERRED EMBODIMENT

Figure 1:
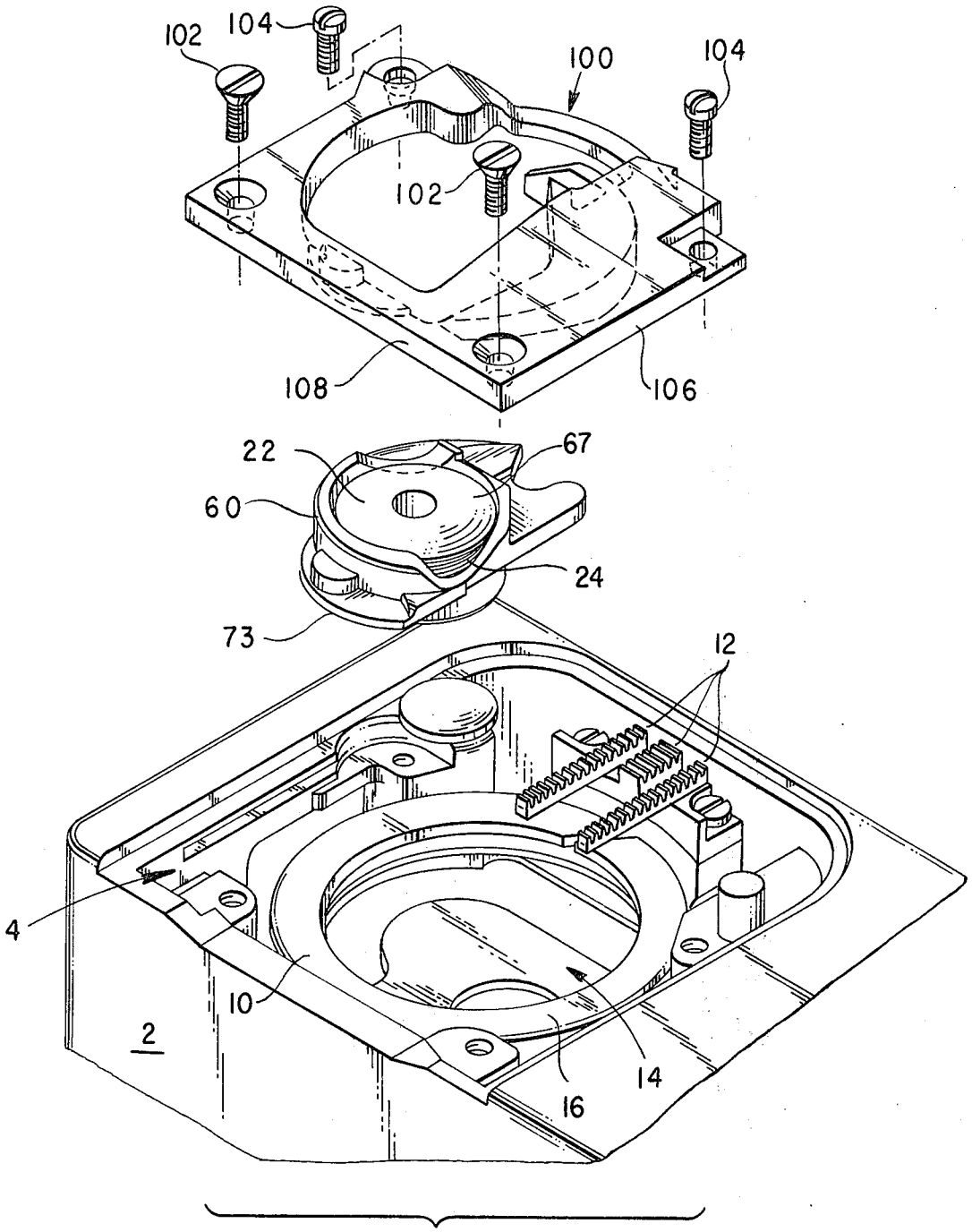
FIG. 1 is an exploded perspective view of a portion of a sewing machine showing a preferred embodiment of the invention.
Figure 2:
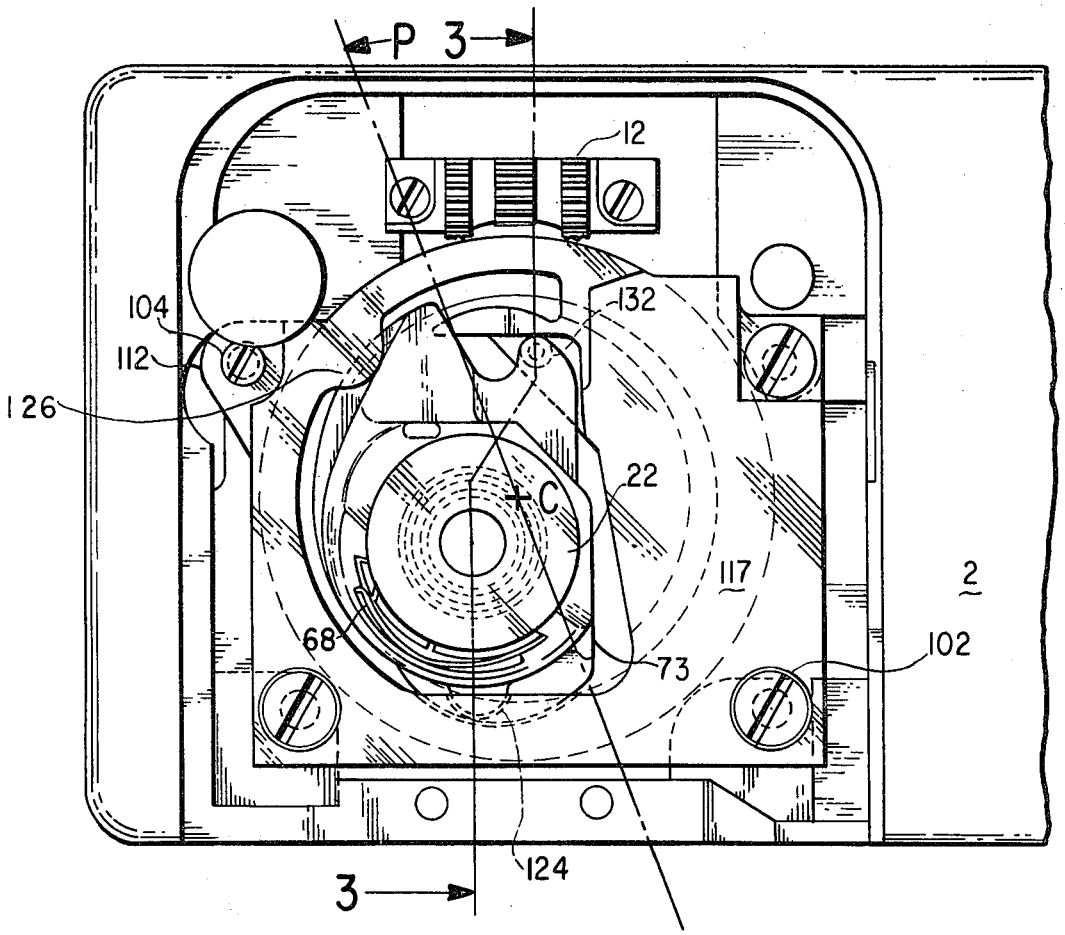
FIG. 2 is a plan view of the area of the sewing machine shown in FIG. 1.
Figure 3:
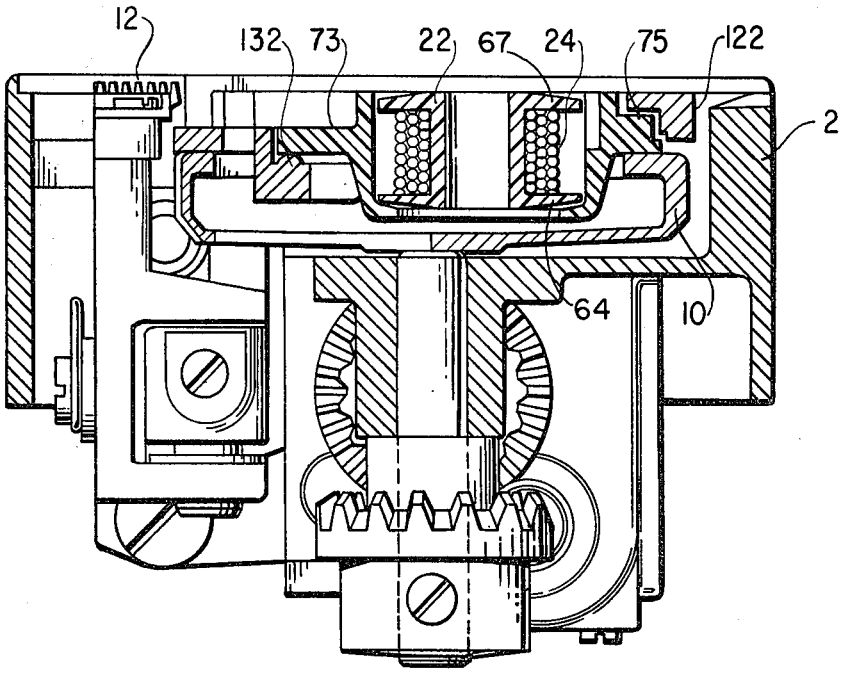
FIG. 3 is a section view taken along lines 3—3 of FIG. 2.

Referring to FIGS. 1 through 3, there is shown a portion of a sewing machine bed 2 having an upwardly open compartment 4 for housing a rotating loop taker 10 and a work feed dog 12. The loop taker 10 has an open ended hollow cavity 14 and a flat upper surface or rim 16. Suspended within the cavity 14 is a bobbin case 60 having a thread carrying bobbin 22 positioned therein, said bobbin 22 having bobbin thread 24 wound thereon.

The bobbin case, which is indicated generally as 60, includes a generally cylindrical central portion 61 formed with a cylindrical bobbin accommodating cavity 62 which is upwardly open and formed at the bottom with a radially inwardly extending ledge 63 adapted to engage and support the bottom flange 64 of a conventional flanged bobbin 22. The cylindrical central portion 61 of the bobbin case may be formed with one or more shallow rim indentations 66 providing space for an operator's finger tips to grip the upper flange 67 of the bobbin in order that bobbins may be replaced or exchanged easily. A conventional bobbin thread tensioning spring 68 is secured by a fastening screw 69 on the inner surface of the central cylindrical portion of the bobbin case. An adjusting screw 70 provides for adjustment of the tension applied by the spring 68 upon the bobbin thread.

The bobbin case 60 includes a flange 71 extending radially outward from the central portion 61 of the bobbin case and perpendicular to the axis of portion 61.

A vertical wall 71' projects upwardly from the flange 71. As shown, the flange is mostly curvilinear but includes a slabbed edge 72. The flange 71 has a planar undersurface 73 and includes a semicircular notch 74. The bobbin case also includes a tab 75 located substantially opposite the notch. The tab may be an integral part of the bobbin case or a separate piece affixed with adhesive or in any other suitable manner to the central portion 61 and flange 71 of the bobbin case.

Figure 6:
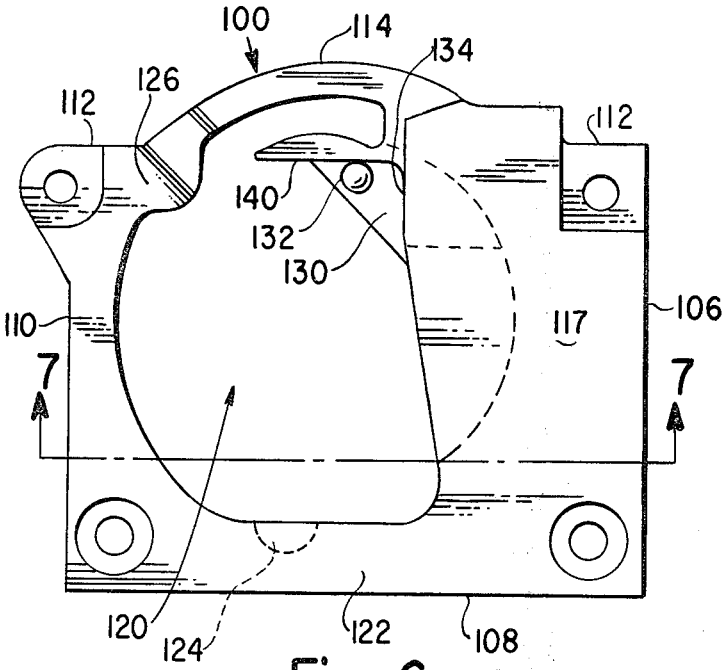
FIG. 6 is a top plan view of the positioning and retaining bracket.
Figure 7:
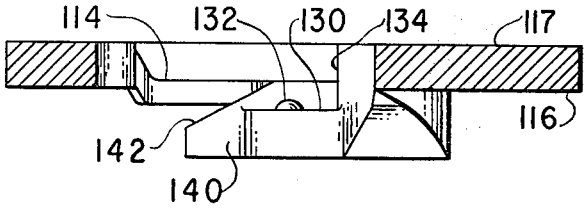
FIG. 7 is a front view of the positioning and retaining bracket.
Figure 5:
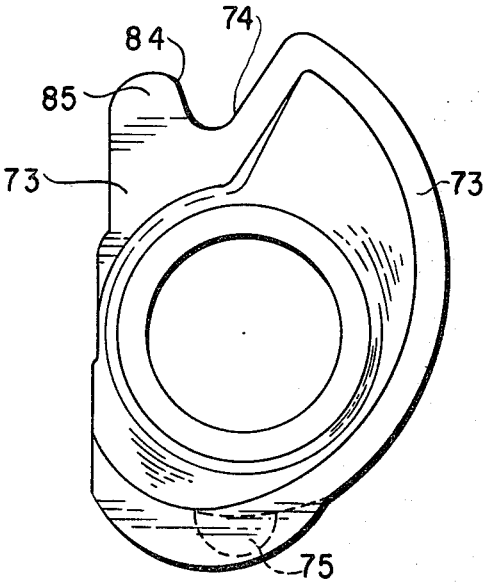
FIG. 5 is a bottom view of the bobbin case.
Figure 4:
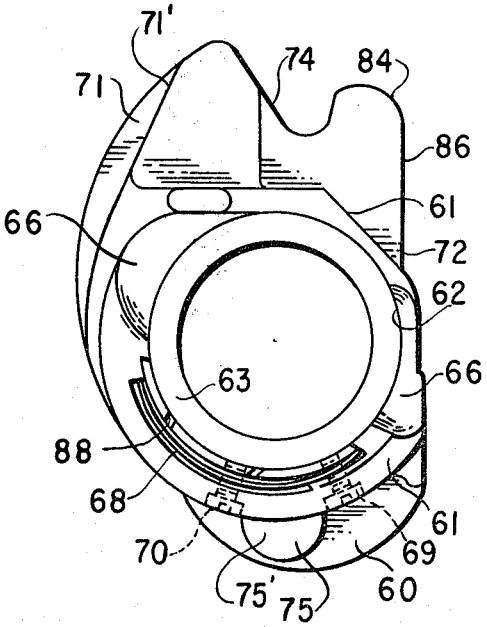
FIG. 4 is a top plan view of the bobbin case.

A bobbin case positioning and restraining bracket generally indicated as 100 is secured by two flat head screws 102 and two round head screws 104 to the bed 2 within the compartment 4. The bracket 100 is generally of rectangular shape having square sides 106, 108, 110 and 112 and a lower surface 116 and upper surface 117 which are parallel. A circularly shaped rib 114 protrudes from the surface 112 and is offset below the surface 116. An opening 120 is provided to loosely embrace the bobbin case 60 and to position or locate it with respect to the loop taker 10 and to restrain the bobbin case 60 in operational engagement therewith. The bracket portion 122 has formed in its undersurface, as viewed in FIG. 6, a circular recess 124 which is open toward the opening 120 and dimensioned to loosely receive the tab 75 of the bobbin case 60 so that thread may pass therebetween. A rounded tab 126 projects into the opening 120 to loosely abut the surface 71' while at the same time overlay a portion of the flange 71 with sufficient clearance for thread to pass between the tab 126 and the bobbin case 60. A surface 130 having an upwardly projecting hemispherical surface 132 is formed parallel to and vertically below the surface 116. Adjacent to and rising vertically from the surface 130 is the abutting surface 134 which terminates at the upper surface 117 of the bracket 100.

The bobbin case 60 is vertically supported at a corner 84 near notch 74 on the hemisphere 132, and is also vertically supported by engagement of the rim 16 of the loop taker with a portion of undersurface 73 of the bobbin case flange 71, this portion being less than 180° of angular displacement. The hemisphere 132 is at a level substantially equal to the loop taker rim 16 so that the bobbin case 60 is level relative to the loop taker. The undersurface 73 of the bobbin case flange which contacts the rim 16 is substantially diametrically opposite the corner 84.

The bobbin case is rotationally and radially constrained by the tab 75 extending into the recess 124, the tab 126 in loose abutting engagement with the surface 71', and the edge 86 of the corner 84 in loose abutting engagement with the surface 134. The bobbin case is axially constrained by the overhang of the tab 126 over the flange 71 and the overhang of the recess 124 of the bracket portion 122 over the surface 75' of the tab 75. The tab 126 and the recess 124 are less than 180° apart, however, since the undersurface 73 is resting on the rim 16 of the loop taker 10 and the clearance between the bobbin case 60 and the bracket 100 is minimal, the bobbin case is absolutely retained in a normal working position between the rim 16 and the bracket 100.

The bobbin case constraining parts are constructed to provide sufficient clearance for the passage of needle thread between the tab 126 and surface 71' as well as between the tab 75 on the bobbin case and the bracket portion 122 as the needle thread is moved by the loop taker 10 about the bobbin case during operation of the sewing machine. A thread guide 140 having a thread camming surface 142 is formed adjacent the surface 130 and at right angles to the surface 134. The camming surface 142 starting at a position that is vertically higher than the hemisphere 132 slopes downwardly and to the left, as viewed in FIG. 6, to a free extremity positioned vertically lower than the hemisphere 132. As a loop of thread is being cast about the bobbin case by the loop taker, the take up limb of the thread loop rides up the camming surface 142 to assure that it does not snag on any part of the bracket 100.

The locations of the tab 126, the recess 124, and the hemisphere 132 are arranged with respect to the axis of rotation C of the loop taker 10, as seen in FIG. 2, so that the tab 126 and the recess 124 will fall on a first side of a plane P which contains the axis C and the hemisphere 132 will fall on a second side of the plane P. Additionally, the portion of the under surface 73 of the bobbin case flange 71 which engages the rim 16 falls entirely on the first side of the plane P.

A most important aspect of this invention is the feature whereby once the bobbin case is inserted and the bracket fastened in place, there is no possibility that the bobbin case will move out of operating position as a result of vibrational and other forces caused by the normal operation of the machine.

Upon reviewing the present disclosure, a number of alternative constructions will occur to one skilled in the art. Such constructions may utilize overlay and support locations slightly varied in both position and shape from those of the present invention. Such alternative constructions are considered to be within the spirit and scope of this discloure.

I claim:

1. A sewing machine having a work supporting bed, a loop taker arranged for rotation about a vertical axis, said loop taker having a rim including a thread seizing beak formed therein, a bobbin case within said loop taker, a bracket removably attached to said bed and with said loop taker providing the sole support for constraining said bobbin case rotationally, radially, and vertically said bracket loosely connect to said bobbin case to permit the passage of thread between said bobbin case and said bracket during the formation of lockstitches, said bobbin case being vertically supported only at a first location on said bracket and at a second location on said rim of said loop taker, said second location having less than 180° of angular displacement, said bracket being of unitary integral construction having a vertical wall adjacent said first location on said bracket for loosely abutting said bobbin case, said bracket overlaying a portion of said bobbin case in third and fourth spaced apart locations, said second, third, and fourth locations being positioned on one side of a plane containing said vertical axis of said loop taker and said first location being positioned on the other side of said plane whereby said bobbin case is retained in operational engagement with said rim and removal of said bobbin case is prevented without removal of said bracket.

2. The combination of claim 1 wherein said bracket overlaying portion of one of said third and fourth spaced apart locations is formed in the underside with a recess and said bobbin case includes a projection extending beneath said bracket overlaying portion and arranged to loosely engage said recess for effecting said rotational constraint of said bobbin case.

3. The combination of claim 2 wherein said first location on said bracket includes an upwardly projecting generally hemispherical surface for said vertically supporting said bobbin case.

4. The combination of claim 3 including a thread guide formed adjacent said first location and extending generally at right angles to said vertical wall, said thread guide being formed with a thread camming surface arranged to guide thread to prevent snagging thereof.

5. The combination of claim 4 wherein said thread guide includes a free extremity and projects from said vertical wall and said thread camming surface is vertically higher than said upwardly projecting hemispherical surface adjacent said vertical wall and slopes downward to the free extremity positioned lower than said hemispherical surface.

* * * * *